US006849285B2

(12) United States Patent
Masek et al.

(10) Patent No.: US 6,849,285 B2
(45) Date of Patent: Feb. 1, 2005

(54) SEALED CARTRIDGE FOR MAKING A BEVERAGE

(75) Inventors: Petr Masek, Granges (CH); Alfred Yoakim, St-Legier-La-Chiesaz (CH)

(73) Assignee: Nestec S.A., Vevey (CH)

( * ) Notice: Subject to any disclaimer, the term of this patent is extended or adjusted under 35 U.S.C. 154(b) by 404 days.

(21) Appl. No.: 09/954,957

(22) Filed: Sep. 18, 2001

(65) Prior Publication Data

US 2002/0015768 A1 Feb. 7, 2002

Related U.S. Application Data

(63) Continuation of application No. PCT/EP00/01752, filed on Mar. 2, 2000.

(51) Int. Cl.[7] ..... A23F 5/26; B65B 29/02; A47J 31/40

(52) U.S. Cl. ..... 426/112; 99/295; 99/302 R; 426/77; 426/84; 426/115

(58) Field of Search ..... 99/295, 302 R; 426/77, 84, 112, 115; 215/247, DIG. 3; 220/203.17, 203.18

(56) References Cited

U.S. PATENT DOCUMENTS 2,436,291 A * 2/1948 Daniel
2,778,739 A * 1/1957 Rodth
2,848,130 A * 8/1958 Jesnig
2,899,886 A * 8/1959 Rodth
2,905,075 A * 9/1959 Liebelt
2,968,560 A * 1/1961 Goros
3,292,527 A * 12/1966 Stasse
3,403,617 A * 10/1968 Campe
3,589,272 A * 6/1971 Bouladon
3,607,297 A * 9/1971 Fasand
3,628,444 A * 12/1971 Mazza
3,719,505 A * 3/1973 Mazza
3,812,273 A * 5/1974 Schmidt
4,136,202 A 1/1979 Favre ..... 426/77
4,226,333 A * 10/1980 Percarpio
4,236,647 A * 12/1980 Kotturan
4,301,936 A * 11/1981 Percarpio
4,773,552 A * 9/1988 Boege et al.
4,846,052 A * 7/1989 Favre et al.
5,008,013 A * 4/1991 Favre et al.
5,111,946 A * 5/1992 Glanz
5,202,093 A * 4/1993 Cloyd
5,242,702 A * 9/1993 Fond (List continued on next page.)

FOREIGN PATENT DOCUMENTS

| | | |
|---|---|---|
| EP | 0 512 468 | 11/1992 |
| EP | 0 512 470 | 11/1992 |
| FR | 2 373 999 | 7/1978 |
| FR | 2 668 451 | 4/1992 |

*Primary Examiner*—Steve Weinstein
(74) *Attorney, Agent, or Firm*—Winton & Strawn LLP

(57) ABSTRACT

The invention relates to a sealed cartridge, provided to be extracted under pressure, containing a substance (15) for preparing a beverage, comprising a dish (9) with a bottom (10) and a side wall (11), having substantially the shape of a frustum of a cone, and a circular edge with a diameter greater than the bottom, and a cover (12) welded to the periphery of the edge of the dish, in which the cover (12) consists of a flexible material which is impermeable to oxygen, chosen from the group consisting of aluminum, an aluminum/plastic composite, an aluminum/plastic/paper composite, pure or multi-layer plastic, the said cartridge not comprising a filter or a weakening zone and the cover being intended to be torn only through the effect of the force of the extraction fluid when extraction starts, the said cartridge comprising, in the dish at the level of the bottom, a barrier (13) that is automatically resealable against leakage of the substance upon withdrawal of the fluid injection needle.

17 Claims, 2 Drawing Sheets

U.S. PATENT DOCUMENTS 5,327,815 A * 7/1994 Fond et al.
5,398,595 A * 3/1995 Fond et al.
5,402,707 A 4/1995 Fond et al. ..... 99/295
5,472,719 A 12/1995 Favre ..... 426/77
5,656,316 A 8/1997 Fond et al. ..... 426/433
5,773,067 A * 6/1998 Freychet et al.
5,897,899 A 4/1999 Fond ..... 426/112
5,948,455 A * 9/1999 Schaeffer et al.
6,017,317 A * 1/2000 Newby et al.
6,024,235 A * 2/2000 Schwab
6,030,582 A * 2/2000 Levy
6,234,335 B1 * 5/2001 Gee et al.
6,361,744 B1 * 3/2002 Levy

* cited by examiner

SEALED CARTRIDGE FOR MAKING A BEVERAGE

CROSS-REFERENCE TO RELATED APPLICATIONS

This application is a continuation of International Application No. PCT/EP00/01752, filed on Mar. 2, 2000, the content of which is expressly incorporated herein by reference thereto.

FIELD OF THE INVENTION

The invention relates to a sealed cartridge containing a food component for producing a food product when fluid is injected into the cartridge. More specifically, the invention is related to a sealed cartridge with a barrier to prevent leakage of the food component upon withdrawal of a fluid injector.

BACKGROUND OF THE INVENTION

Sealed cartridges are known, provided to be extracted under pressure, containing a substance for the preparation of a beverage chosen from ground roasted coffee, tea, instant coffee, a mixture of ground coffee and of instant coffee, a chocolate-based product or any other dehydrated edible substance, comprising a dish with a bottom and a side wall, having substantially the shape of a frustum of a cone, and a circular edge with a diameter greater than the bottom, and a cover welded to the periphery of the edge of the dish, in which the cover consists of a flexible material which is impermeable to oxygen, chosen from the group consisting of aluminium, an aluminium/plastic composite, an aluminium/plastic/paper composite, pure or multi-layer plastic, the said cartridge not comprising a filter or a weakening zone and the cover being intended to be torn only through the effect of the force of the extraction fluid when extraction starts.

The sealed cartridge described above is the subject of Patent EP 512,468, in the name of the applicant. This cartridge is extracted with the device forming the subject of Patent EP 512,470. This extraction takes place in the following manner: the cartridge is inserted into a cartridge holder and into an extraction cage. This extraction cage comprises a needle which will pierce the bottom of the dish and, when the pressure in the cartridge rises, the cover will bear on protruding and hollowed-out elements of the extraction device. When the pressure reaches a certain level, the cover reaches its rupture tension and it opens, allowing the coffee to flow into the cup. At the end of extraction, it is possible to remove the cartridge from the extraction system in order to place the next one therein. When the said cartridge is removed, there is a hole in the bottom of the dish and this hole allows residual water and coffee grounds to escape. This leakage of grounds causes a problem, because it soils part of the extraction machine.

SUMMARY OF THE INVENTION

The aim of the present invention is to perfect a cartridge provided for the same type of extraction as mentioned above and which does not lead to leaks of grounds or of any other solid substance when the cartridge is changed.

The present invention relates to a sealed cartridge for preparing a fluid food product. This cartridge includes a dish at the level of the bottom, in which is provided a means guaranteeing the retention of solid substance when it the cartridge is open. This involves arranging, in each cartridge, a non-return system for the coffee grounds or for any other solid substance extracted in the cartridge. This system must suit the existing construction of the extraction head.

The means guaranteeing the retention of solid substance is chosen from the group consisting of a fabric, a valve and a foam, and the means is placed, adhesively bonded or sealed to the bottom of the cartridge. The three aforesaid means are firstly acceptable in terms of cost and, secondly, are simple to produce, allow easy opening by the injection needle, are satisfactorily resistant to hot water and provide satisfactory closure after extraction, i.e. when the cartridge is removed.

The fabric used may be any type of fabric, woven or non-woven, made from plastic fibers, from vegetable fibers or from animal fibers. The fabric used is preferably fabric made from polypropylene, polyester or polyurethane having a thickness of between 15 and 100 microns. The fabric may be simply placed in and hot-sealed to the bottom of the dish.

The valve used may be of any type, for example a flexible plastic disc with a cross-shaped cut-out, i.e. with four branches. It is also possible to have a valve with a three-branch or six-branch cut-out. The valve may be adhesively bonded or hot-sealed, but it is also possible to simply place it in the bottom of the dish. This valve is preferably made from polypropylene or polyethylene.

The foam used is made from a flexible plastic, for example from PUR (polyurethane) or EVA (ethylene-vinyl acetate copolymer). It also may be hot-sealed to the bottom of the dish.

The cover is heat-welded or crimped to the periphery of the dish. A cartridge which can withstand the pressures which may range up to 15 bar in the extraction system is thereby obtained.

The cartridge is filled with a substance for the preparation of a beverage, as mentioned above. This substance is preferably ground roasted coffee.

"Dish" is understood to mean a frustoconical, hemispherical or frustopyramidal element. Naturally, the bottom of the dish may be, but does not have to be, flat.

The principal body of the cartridge, namely the dish, of frustoconical shape and of semi-rigid nature, may consist of a material chosen from aluminium having a thickness of 20 to 100 $\mu$m, a pure or multi-layer plastic, a cardboard/aluminium/plastic composite or a cardboard/plastic composite.

The cover of the cartridge has a flexible nature, and advantageously may be made from a material chosen from aluminium with a thickness of 15 to 60 $\mu$m and a multi-layer material comprising either paper of 20 to 60 g/m$^2$, plastic of a thickness of 20 to 60 $\mu$m and aluminium of a thickness of 5 to 20 $\mu$m, or EVOH or PVDC of a thickness of 5 to 30 $\mu$m and plastic (PP, PE or PA) of 20 to 100 $\mu$m, or PET (5 to 30 $\mu$m) and plastic (PP, PE) of 20 to 100 $\mu$m, or PET that is metallized or equipped with a layer which forms an efficient barrier, such as $SiO_2$.

The size of the cartridge according to the invention may vary according to the volume of coffee it is desired to prepare. The measure of coffee may vary between 5 and 20 g, the diameter of the cartridge is between 2.5 and 6 cm and the thickness of the bed of coffee between 10 and 40 mm.

BRIEF DESCRIPTION OF THE DRAWINGS

The remainder of the description is given with reference to the drawings, in which.

DETAILED DESCRIPTION OF THE PREFERRED EMBODIMENTS

Figure 1:
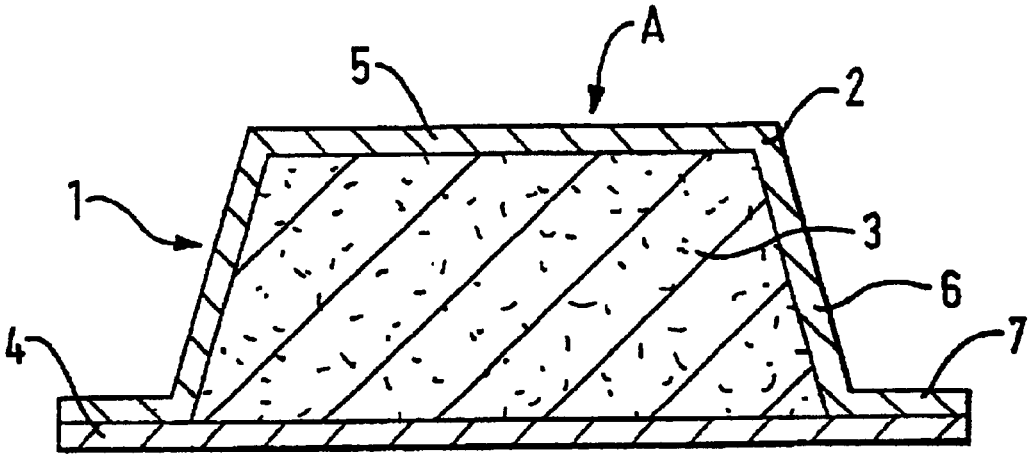
PRIOR ART FIG. 1
FIG. 1 is a diagrammatic representation of a prior art cartridge.

The cartridge (1) includes a dish (2) with a bottom (5) and a side wall of frustoconical shape (6). The cartridge contains roasted coffee (3) and it is sealed by means of a cover (4) made from aluminium. This cover is welded to the periphery (7) of the edge of the dish. When extraction takes place, the needle perforates the bottom of the cartridge in the zone A, allowing the extraction liquid to percolate into the coffee. At the end of extraction, the coffee grounds emerge from the opening in the zone A. The aim of the present invention is to prevent this emergence of grounds. To this end, there are at least three different solutions.

Figure 2:
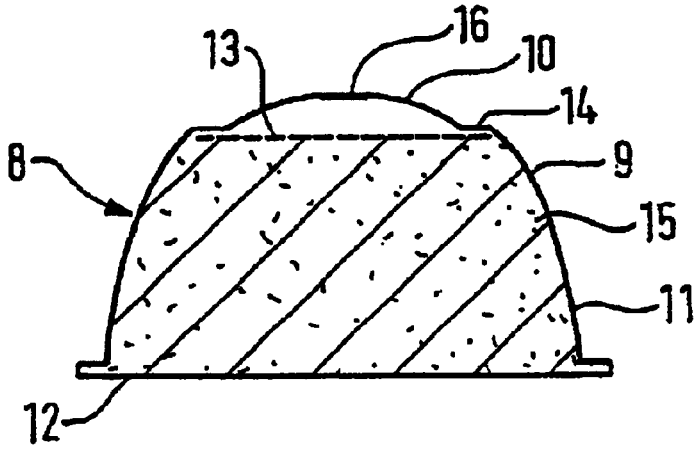
FIG. 2 is a diagrammatic representation of the cartridge according to the invention, in a first embodiment.

The solution of FIG. 2 is to provide a barrier, which in this embodiment is a layer of fabric (13) made from polyester in the cartridge (8) having a dish (9) with a bottom (10) and a side wall (11) and a cover (12). This layer is welded to the shoulder (14) of the cartridge. The bed of coffee (15) is deposited on the fabric (13). The advantage of this fabric is that the needle perforates it easily and, at the end of extraction, its flexibility and its elasticity allow it to close again when the said needle is removed from the cartridge and the grounds do not exit via the opening (16). A cartridge guaranteeing satisfactory cleanliness of the extraction system is thus provided.

Figure 3:
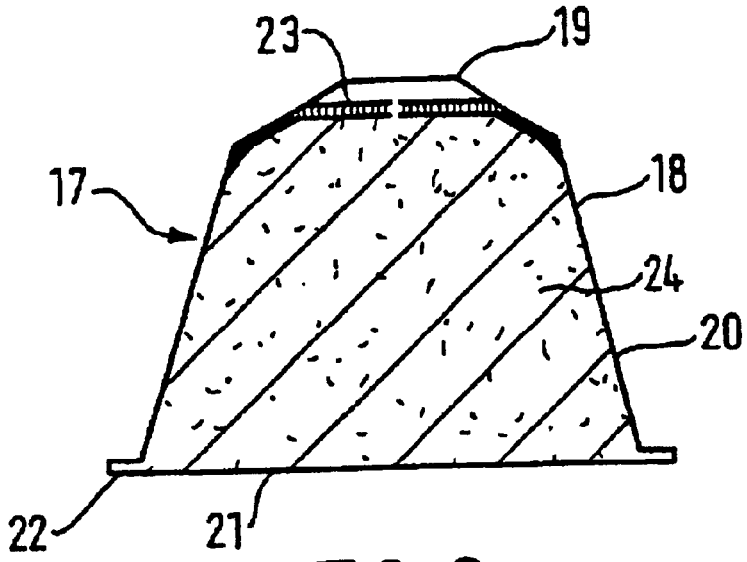
FIG. 3 is a diagrammatic representation of the cartridge according to the invention, in a second embodiment.

FIG. 3 provides a second solution in the form of a cartridge with a non-return device. The cartridge (17) comprises a dish (18) with a bottom (19) and side wall (20), together with a cover (21) welded to the periphery (22) of the dish. A valve (23) is adhesively bonded close to the bottom (19). The bed of coffee (24) is deposited on this valve. This valve has, for example, a cross-shaped cut-out, which allows satisfactory opening and satisfactory re-closing when the extraction needle is inserted and removed. It also allows satisfactory retention of the coffee grounds. It is also possible to arrange the valve of FIG. 3 in the cartridge of FIG. 2 and vice versa and it is possible to weld the layer of fabric of FIG. 2 in the cartridge of FIG. 3.

Figure 4:
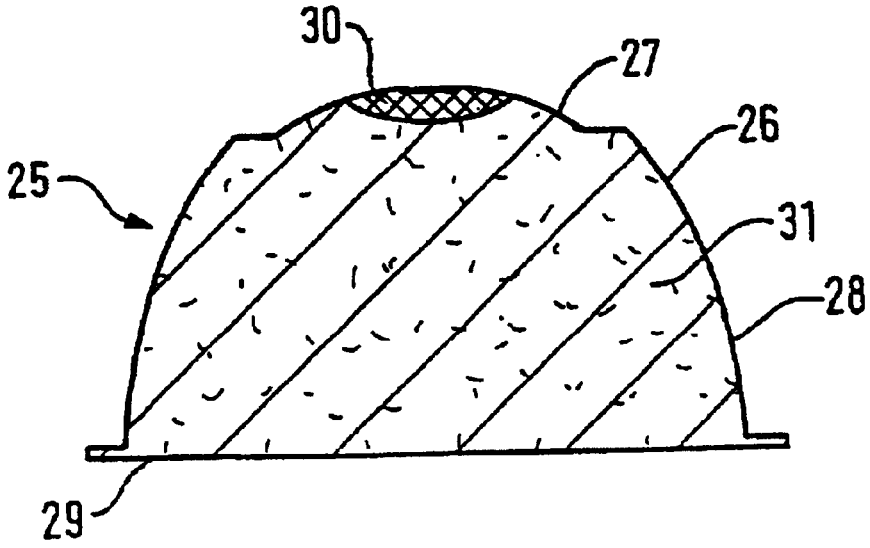
FIG. 4 is a diagrammatic representation of the cartridge according to the invention, in a third embodiment.

FIG. 4, finally, shows a cartridge (25) comprising a dish (26) with a bottom (27) and a side wall (28) and a cover (29). The bottom of the cartridge includes an adhesively bonded layer of foam made from flexible plastic (30). The bed of coffee (31) is deposited on this foam. It is perforated easily and it has a satisfactory re-closing ability when the extraction needle is removed. The foam of FIG. 4 may also be arranged in the cartridge according to FIG. 3.

What is claimed is:

1. A cartridge for preparing a fluid food product, comprising:

a container comprising a cover configured for rupturing against protruding hollowed-out elements of an extraction cage upon injection of a fluid into the cartridge at at least a rupturing pressure within the cartridge;

a food component contained within the container and configured for producing the food product upon contact with the fluid; and a barrier mounted to the container adjacent to the food component for retaining the food component within the container;

wherein the container and barrier are configured for puncturing by an injection needle for injecting the fluid into the container to produce the rupturing pressure, the barrier being configured for resealing itself against leakage of the food component from within the container upon withdrawal of the needle therefrom.

2. The cartridge of claim 1, wherein the food product comprises a beverage.

3. The cartridge of claim 2, wherein the food component comprises tea, ground coffee, instant coffee, a chocolate based product, or a mixture thereof.

4. The cartridge of claim 1, wherein the food component comprises a dehydrated edible substance.

5. The cartridge of claim 1, wherein the barrier is disposed within the container.

6. The cartridge of claim 1, wherein the container comprises a first container member to which the cover is attached, and the barrier is attached to the first container member.

7. The cartridge of claim 6, wherein the first container member comprises a concave dish portion.

8. The cartridge of claim 1, wherein the barrier is sufficiently resilient to allow perforation by the needle but which resiliently reseals itself against leakage of the food component upon withdrawal of the needle.

9. The cartridge of claim 1, wherein the barrier comprises a valve positioned and configured for opening to receive the needle, and for closing to retain the food component within the cartridge upon withdrawal of the needle.

10. The cartridge of claim 9, wherein the valve defines a cut-out with a plurality of branches configured for opening around the needle and closing upon withdrawal thereof.

11. The cartridge of claim 1, wherein the container is impermeable to oxygen and the cover comprises aluminium, plastic, a composite thereof, an aluminium/plastic/paper composite, or multi-layer plastic.

12. A cartridge for preparing a food product, comprising:

a container comprising a cover configured for rupturing against protruding hollowed-out elements of an extraction cage upon injection of a fluid into the cartridge at at least a rupturing pressure within the cartridge;

a food component contained within the container and configured for producing the food product upon contact with the fluid; and a barrier mounted to the container adjacent to the food component and being substantially impervious to the food component for retaining the food component within the container;

wherein the container and barrier are configured for puncturing by an injection needle for injecting the fluid into the container to produce the rupturing pressure, wherein the barrier is sufficiently resilient for perforating with the needle and resiliently resealing itself against leakage of the food component.

13. The cartridge of claim 12, wherein the barrier comprises a layer of elastic fabric.

14. The cartridge of claim 13, wherein the fabric comprises polyester.

15. The cartridge of claim 12, wherein the barrier comprises a resilient foam.

16. The cartridge of claim 15, wherein the foam is a plastic foam.

17. The cartridge of claim 1, wherein the barrier is substantially impervious to the food component.

* * * * *

UNITED STATES PATENT AND TRADEMARK OFFICE

CERTIFICATE OF CORRECTION

PATENT NO. : 6,849,285 B2
DATED : February 1, 2005
INVENTOR(S) : Masek et al

It is certified that error appears in the above-identified patent and that said Letters Patent is hereby corrected as shown below:

Title page,
Insert Item -- [30] Foreign Application Priority Data
Mar. 18, 1999 (EP) …….. 99105596 --.

Signed and Sealed this

Tenth Day of May, 2005

JON W. DUDAS
*Director of the United States Patent and Trademark Office*